US008793935B2

(12) United States Patent
Makarewicz et al.

(10) Patent No.: US 8,793,935 B2
(45) Date of Patent: Aug. 5, 2014

(54) DOOR HINGE ASSEMBLY FOR AN INTERIOR WALL SYSTEM

(71) Applicant: Teknion Limited, Toronto (CA)

(72) Inventors: Ganadij Peter Makarewicz, Caledon (CA); Paul Frederick Kruger, Toronto (CA)

(73) Assignee: Teknion Limited, Toronto (CA)

( * ) Notice: Subject to any disclaimer, the term of this patent is extended or adjusted under 35 U.S.C. 154(b) by 0 days.

(21) Appl. No.: 13/895,519

(22) Filed: May 16, 2013

(65) Prior Publication Data

US 2013/0312332 A1 Nov. 28, 2013

Related U.S. Application Data

(60) Provisional application No. 61/650,682, filed on May 23, 2012.

(51) Int. Cl.
*E05D 7/08* (2006.01)

(52) U.S. Cl.
USPC ..... 49/388; 16/382; 16/387

(58) Field of Classification Search
USPC ..... 49/38, 385, 388, 390, 391, 392; 16/382, 16/387
See application file for complete search history.

(56) References Cited

U.S. PATENT DOCUMENTS 27,788 A * 4/1860 Fayman ..... 16/387
4,087,942 A * 5/1978 Herrmann ..... 49/501
4,118,827 A * 10/1978 Yamamoto ..... 16/252
4,304,027 A * 12/1981 Di Fazio ..... 16/249
4,424,607 A * 1/1984 Langenhorst ..... 16/387
4,932,101 A * 6/1990 Lualdi ..... 16/255
4,937,916 A * 7/1990 Redman ..... 16/243
5,150,500 A * 9/1992 Bisbing ..... 16/239
5,172,452 A * 12/1992 Brown ..... 16/387
5,819,372 A * 10/1998 Magoon ..... 16/382

(Continued)

FOREIGN PATENT DOCUMENTS

JP 06137017 A * 5/1994 ..... E05D 11/08

OTHER PUBLICATIONS

Dirtt, Agile Architectural Solutions, Overview—Tech Sheet Pivot Doors, Pivot Doors_Tech_V1, Jun. 29, 2010.

*Primary Examiner* — Jerry Redman
(74) *Attorney, Agent, or Firm* — Bereskin & Parr LLP/S.E.N.C.R.L., s.r.l.

(57) ABSTRACT

A door hinge assembly includes a vertical post secured to a bottom rail. An upper post hinge portion and a lower post hinge portion are secured to the post. Each post hinge portion includes: (i) a post mounting plate; and (ii) a bearing portion projecting outwardly from the post mounting plate. The bearing portion includes a base with a vertical base bore. The assembly also includes an upper door hinge portion and a lower door hinge portion. Each door hinge portion includes: (i) a block securable to a door frame; (ii) a barrel portion projecting outwardly from the block, the barrel portion having a vertical barrel bore; and (iii) an upper pivot pin and a lower pivot pin, where a first end of each pin is secured in the base bore and a second end pivots in the barrel bore. The upper pivot pin connects the upper post hinge portion to the upper door hinge portion, and the lower pivot pin connects the lower post hinge portion to the lower door hinge portion.

15 Claims, 7 Drawing Sheets

(56) References Cited

U.S. PATENT DOCUMENTS 6,148,481 A * 11/2000 Chen ..... 16/334
6,434,791 B1 * 8/2002 Chung ..... 16/387
8,042,228 B2 * 10/2011 Jones ..... 16/221
8,505,168 B1 * 8/2013 Chapman ..... 16/382
2006/0260096 A1 * 11/2006 Fries ..... 16/246
2013/0000203 A1 * 1/2013 Platt ..... 49/246

* cited by examiner

DOOR HINGE ASSEMBLY FOR AN INTERIOR WALL SYSTEM

CROSS-REFERENCE TO RELATED APPLICATIONS

This application claims priority to U.S. Provisional Application No. 61/650,682 filed on May 23, 2012, which is incorporated by reference herein in its entirety.

FIELD OF THE INVENTION

This application relates generally to interior wall systems for buildings, and in particular, to a door hinge assembly for an interior wall system.

INTRODUCTION

Interior wall systems are well known. Such systems are commonly used, for example, to finish the open areas in office buildings. One type of interior wall system is a modular partition wall system which is composed of a number of wall panels in a side-by-side arrangement. An example of such a system is described in U.S. Pat. No. 7,814,711.

The above interior wall systems are typically constructed using glass wall panels (whether transparent, translucent, or opaque) and have become increasingly popular due to their aesthetic, environmental and workplace planning qualities. Such wall systems are commonly referred to as "seamless glass walls" or "butt glazed walls".

Interior wall systems are typically used to construct work spaces or enclosures, such as offices, cubicles or meeting rooms. Occupants of such enclosures often require doors for access to the enclosures. Examples of doors that are used in conjunction with interior wall systems include sliding doors (also called barn doors) and pivot doors. The doors may be made of the same material as the wall panels or may be a different material (such as wood for example).

SUMMARY

The following summary is provided to introduce the reader to the more detailed discussion to follow. The summary is not intended to limit or define the claims.

According to an exemplary aspect of the invention, a door hinge assembly for pivotably connecting a door to an interior wall system is provided. The interior wall system has a bottom rail configured for installation in a building having a floor. The door has a door frame. The assembly comprises a generally vertical post configured to be secured to the bottom rail, where the post has a plurality of post fastener holes therein. The assembly also comprises an upper post hinge portion and a lower post hinge portion. Each post hinge portion comprises: (i) a post mounting plate having a plurality of plate fastener holes therein, wherein the post mounting plate is configured to be secured to the post by a plurality of fasteners, wherein each of the fasteners is adapted to pass through a corresponding plate fastener hole and a corresponding post fastener hole; and (ii) a bearing portion projecting outwardly from the post mounting plate, the bearing portion comprising a base, the base having a vertical base bore. The assembly also comprises an upper door hinge portion and a lower door hinge portion. Each door hinge portion comprises: (i) a block securable to a door frame; (ii) a barrel portion projecting outwardly from the block, the barrel portion having a vertical barrel bore; (iii) an upper pivot pin and a lower pivot pin, each pivot pin having a first end configured to be secured in the base bore and a second end configured to be pivotably located in the barrel bore, wherein the upper pivot pin is adapted to pivotably connect the upper post hinge portion to the upper door hinge portion, and the lower pivot pin is adapted to connect the lower post hinge portion to the lower door hinge portion.

DRAWINGS

DETAILED DESCRIPTION

Figure 1:
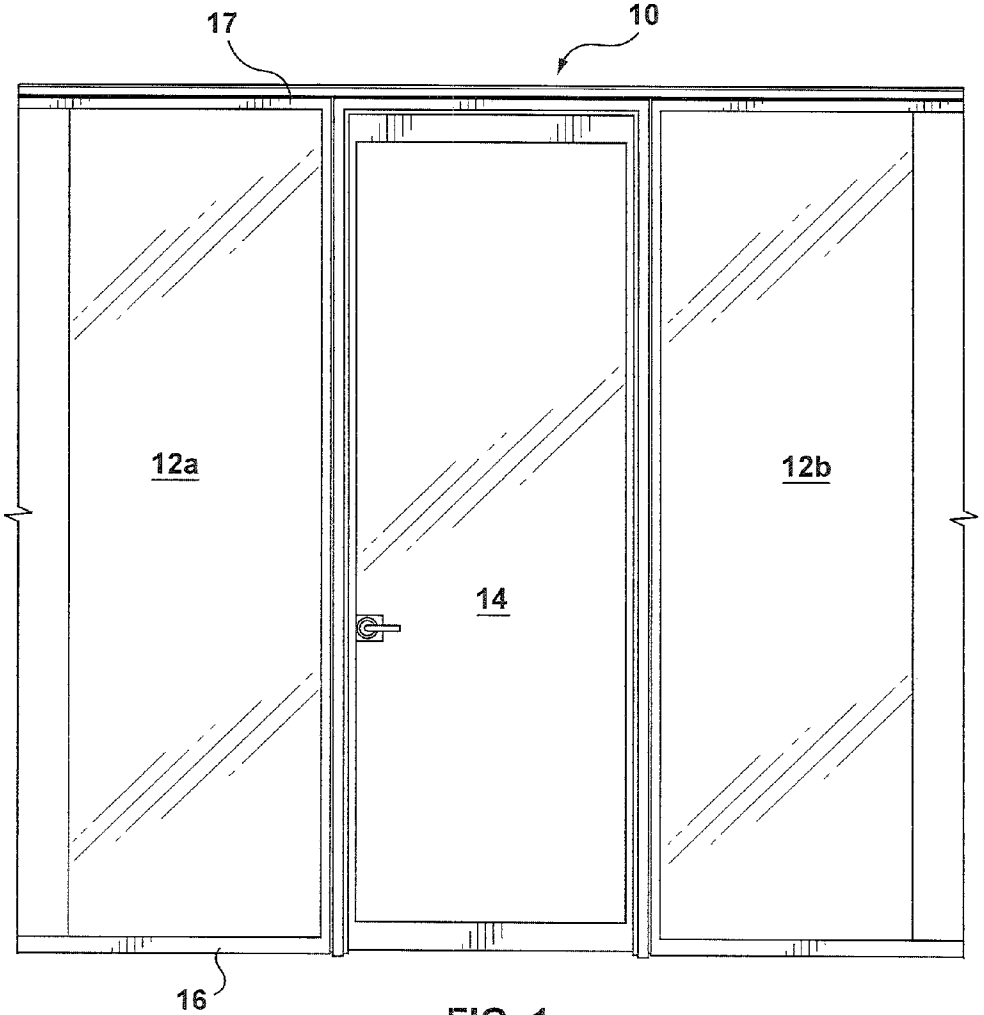
FIG. 1 is an elevation view of a portion of an exemplary interior wall system with a door.

FIG. 1 shows a portion of an interior wall system 10 according to an exemplary embodiment of the present invention. The portion of the interior wall system 10 illustrated in FIG. 1 includes a series of glass wall panels 12*a*, 12*b* separated by a door 14.

The glass wall 12*a*, 12*b* panels are secured to the floor and ceiling of the building by a floor assembly 16 and a ceiling assembly 17, respectively. The floor assembly may be used to level the glass wall panels when the floor surface is not level or is uneven. The glass wall panels may also be secured to each other along the vertical joints. Floor and ceiling assemblies, as well as connections for vertical joints of panels are described in U.S. Pat. No. 7,814,711 issued on Oct. 19, 2010 and pending U.S. patent application Ser. No. 13/742,737 filed on Jan. 16, 2013, all of which are incorporated herein by reference in their entirety.

It will be understood by those skilled in the art that it is not essential that the wall panels 12*a*, 12*b* and door 14 be made of glass. The wall panels and door may be made from any other suitable material, whether transparent, translucent, or opaque. In particular, the door 14 may also be made from wood or wood composite materials.

Figure 2:
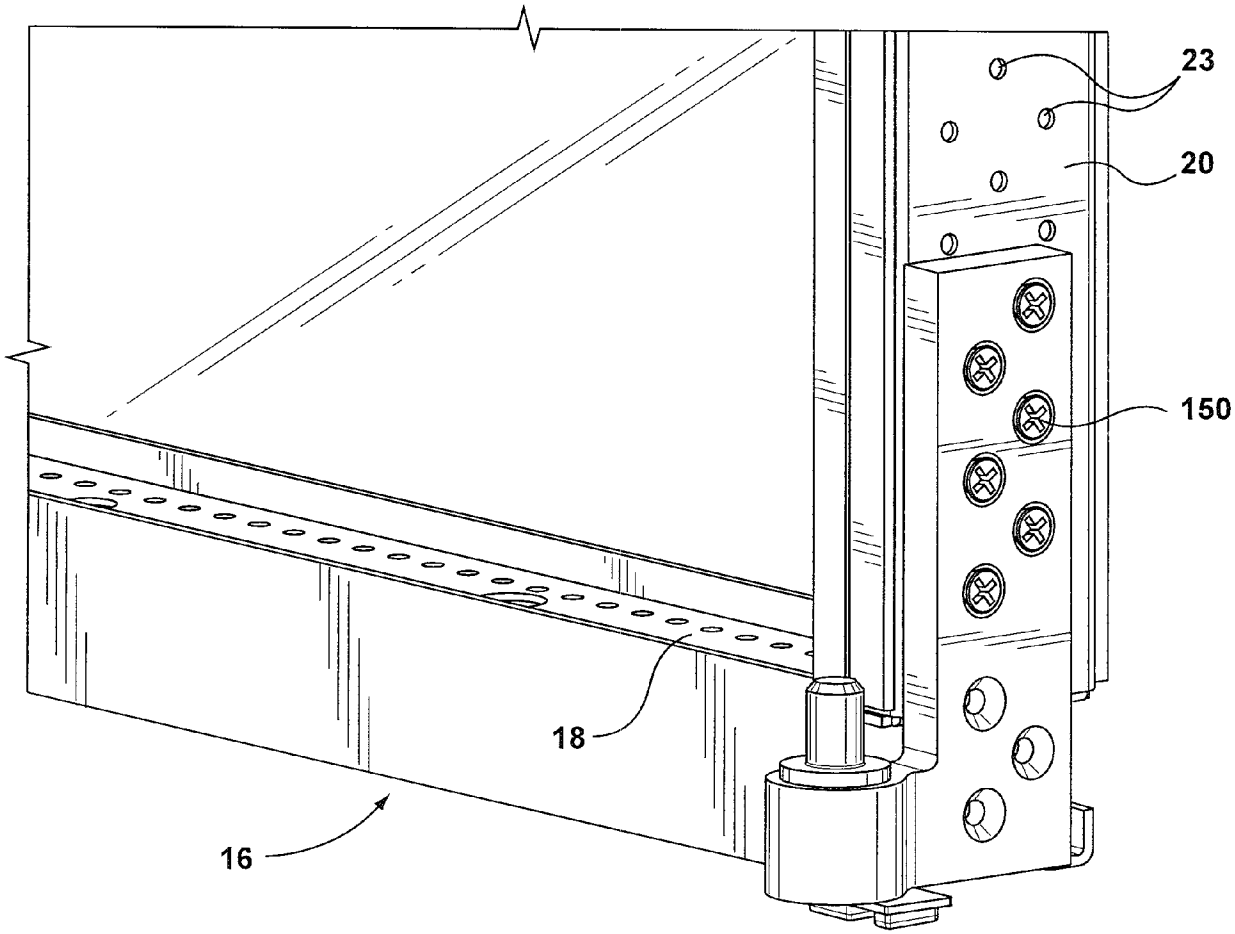
FIG. 2 is a partial perspective view showing a bottom portion of the interior wall system.
Figure 3:
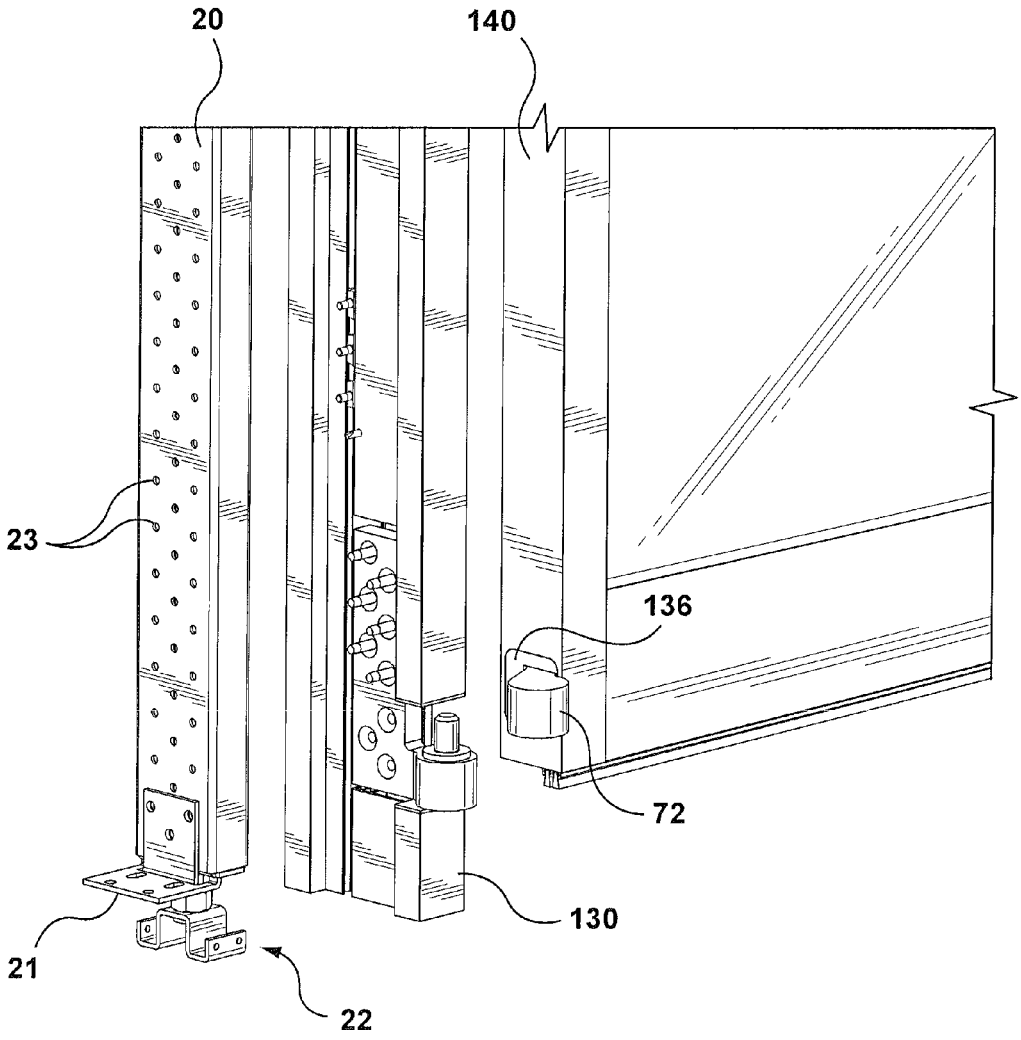
FIG. 3 is an exploded perspective view showing a bottom portion of the interior wall system.

Referring now to FIG. 2, the floor assembly 16 includes a bottom rail 18 which may leveled as discussed above. Referring to FIGS. 2 and 3, a vertical post 20 may be secured to the bottom rail 18 by an L bracket 21. A number of post fastener holes 23 are provided in the post 20. The bottom end of the post 20 rests on a vertical leveling assembly 22. Preferably, the vertical post 20 is constructed from metal tubing having a square or rectangular cross-section.

Figure 4:
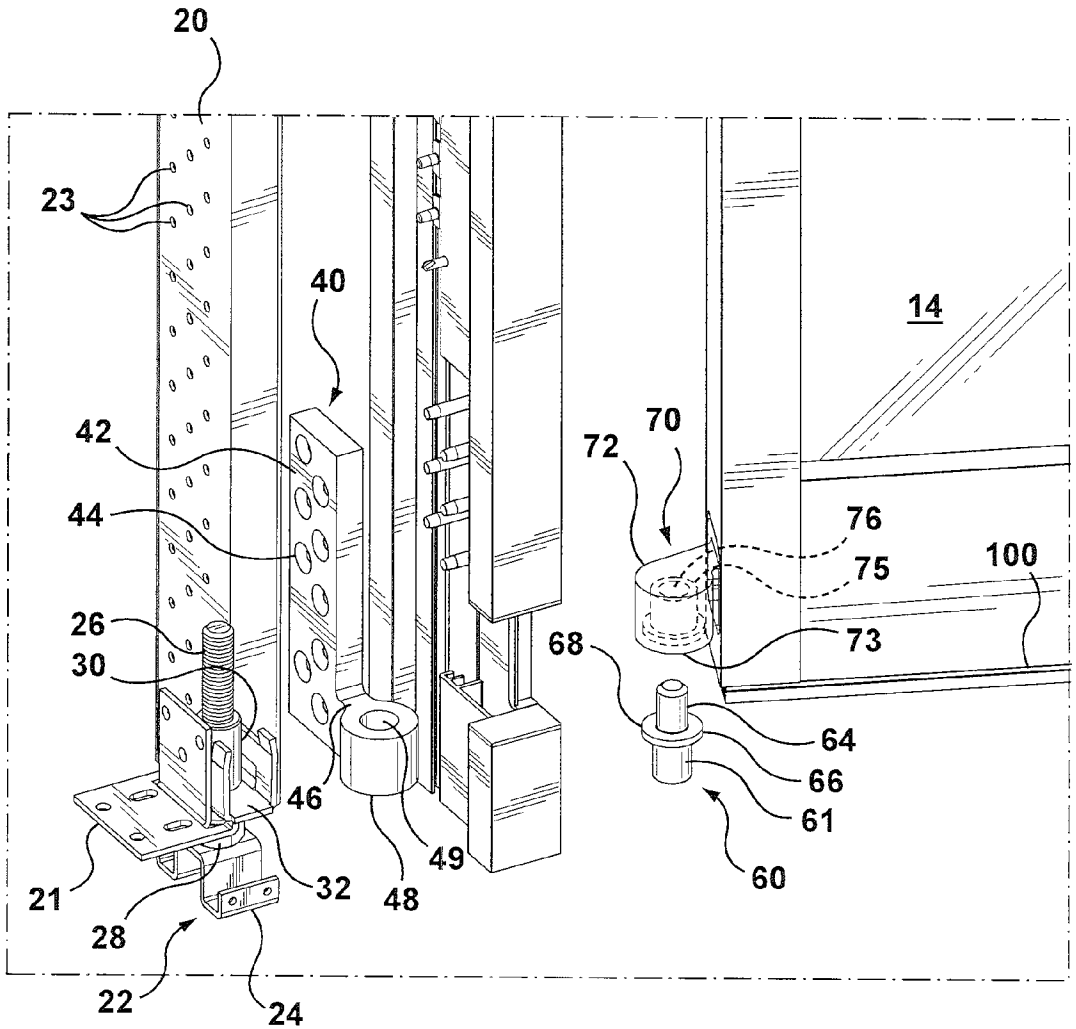
FIG. 4 is a further exploded perspective view showing a bottom portion of the interior wall system.

Referring now to FIG. 4, the leveling assembly 22 includes a foot 24 that rests on the floor. A lower end of a threaded rod 26 is received within a hole (not shown) in the top of the foot 24 in a manner that permits the threaded rod 26 to rotate relative to the foot 24. A nut 28 is fixed to the threaded rod 26. The leveling assembly includes an internally threaded sleeve 30 that includes a flanged portion 32 on which the bottom end of the post 20 rests.

Figure 5:
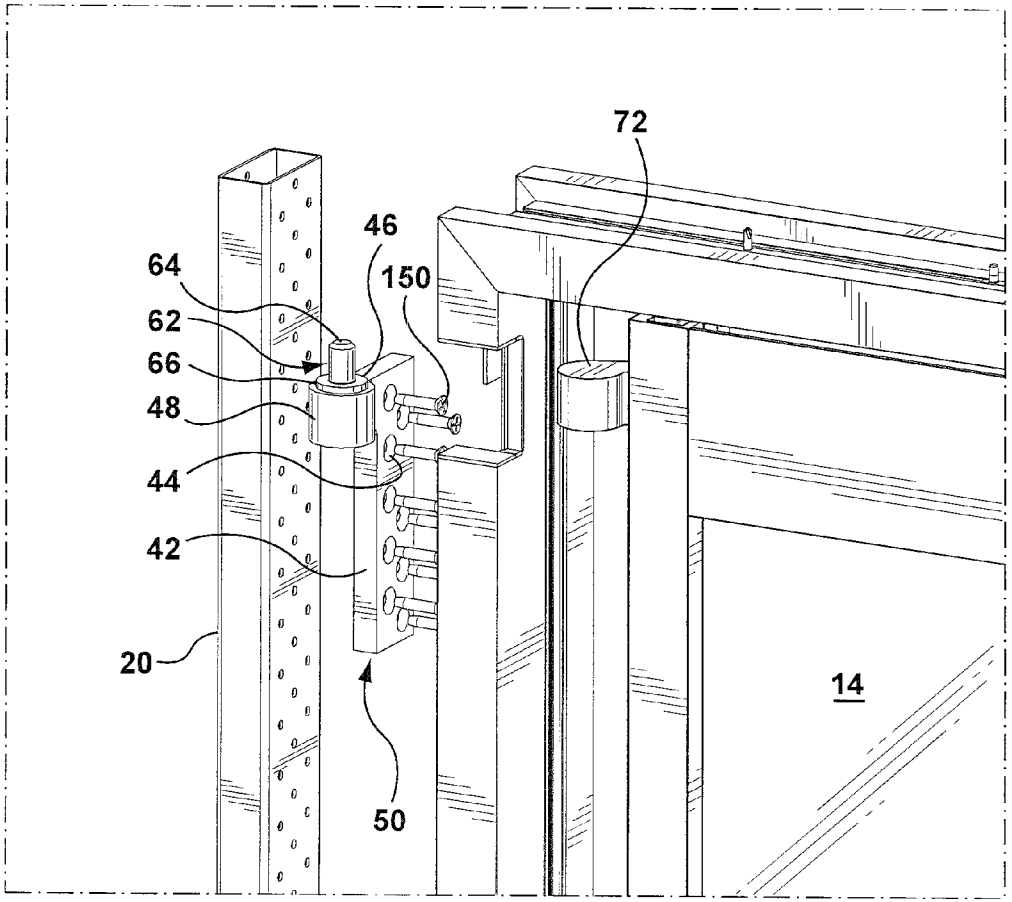
FIG. 5 is an exploded perspective view showing a top portion of the interior wall system.

Referring now to FIGS. 4 and 5, a lower post hinge portion 40 and an upper post hinge portion 50 are secured to the post 20. The lower hinge portion includes a post mounting plate 42 with a number of plate fastener holes 44. An arm 46 extends from a bottom end of the mounting plate 42. A preferably cylindrical bearing portion 48 is connected to the distal end of the arm 46. A vertical base bore 49 extends vertically downward from a top surface of the bearing portion 48. The upper post hinge portion 50 is preferably identical to the lower post hinge portion 40, except that the arm 46 extends from the top end of the mounting plate. Accordingly, parts in the upper post hinge portion 50 have been assigned the same part numbers as the corresponding parts in the lower post hinge portion 40.

FIGS. 4 and 5 illustrate preferably identical lower and upper pivot pins 60 and 62 (only lower pivot pin 60 is fully shown in FIG. 4). Accordingly, the corresponding parts of each pivot pin 60, 62 have been assigned identical part numbers. The lower end 61 of each pivot pin 60, 62 is preferably secured by a press fit in the base bore 49 of the bearing portion 48 of the lower post hinge portion 40 and the upper post hinge portion 50, respectively. Preferably, the lower end 61 of the pivot pins 60, 62 has a larger diameter than an upper end 64. Preferably the lower end 61 and upper end 64 of each pivot pin 60, 62 is separated by an annular shoulder 66 located at about the mid-point 68 of each pivot pin.

Figure 6:
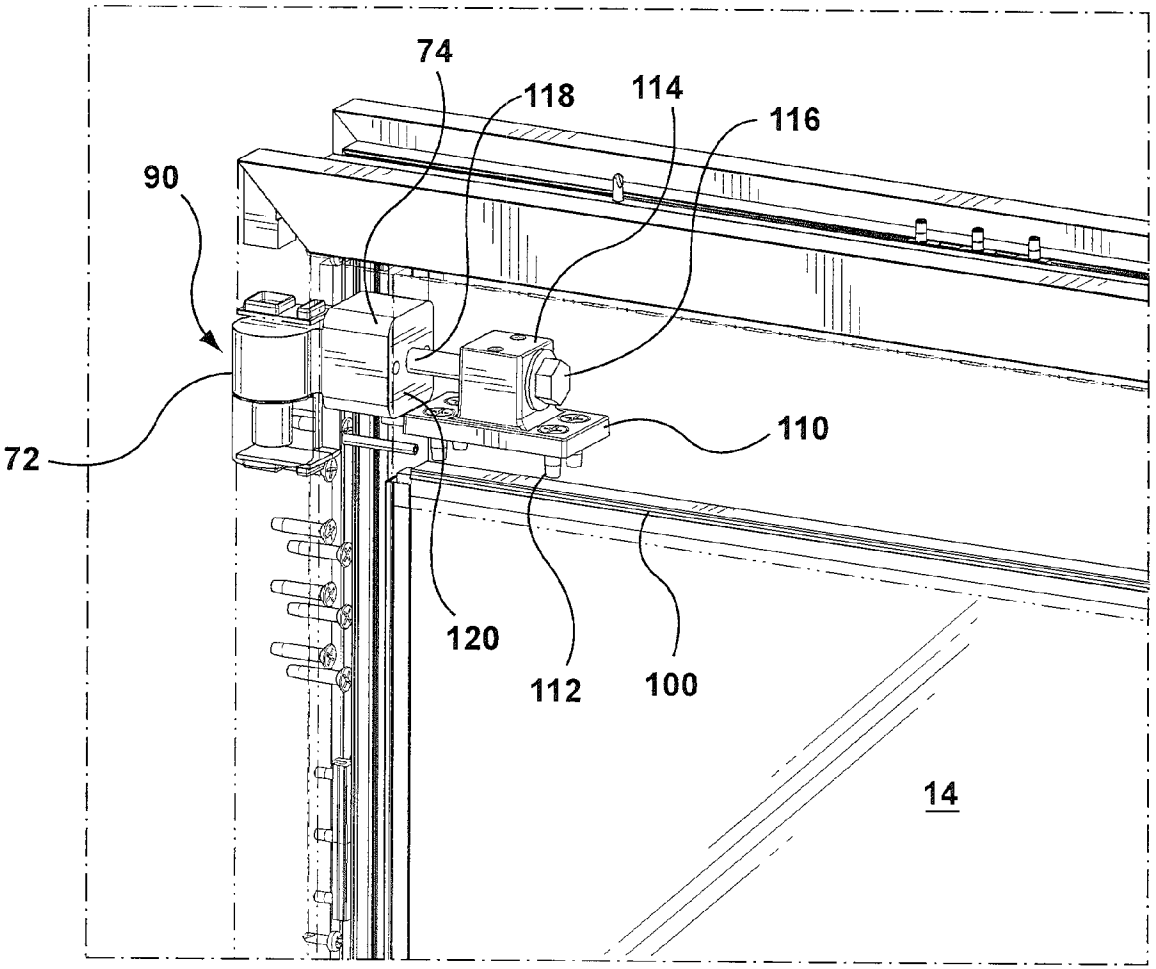
FIG. 6 is an exploded perspective view showing a top portion of an exemplary door of the interior wall system.
Figure 7:
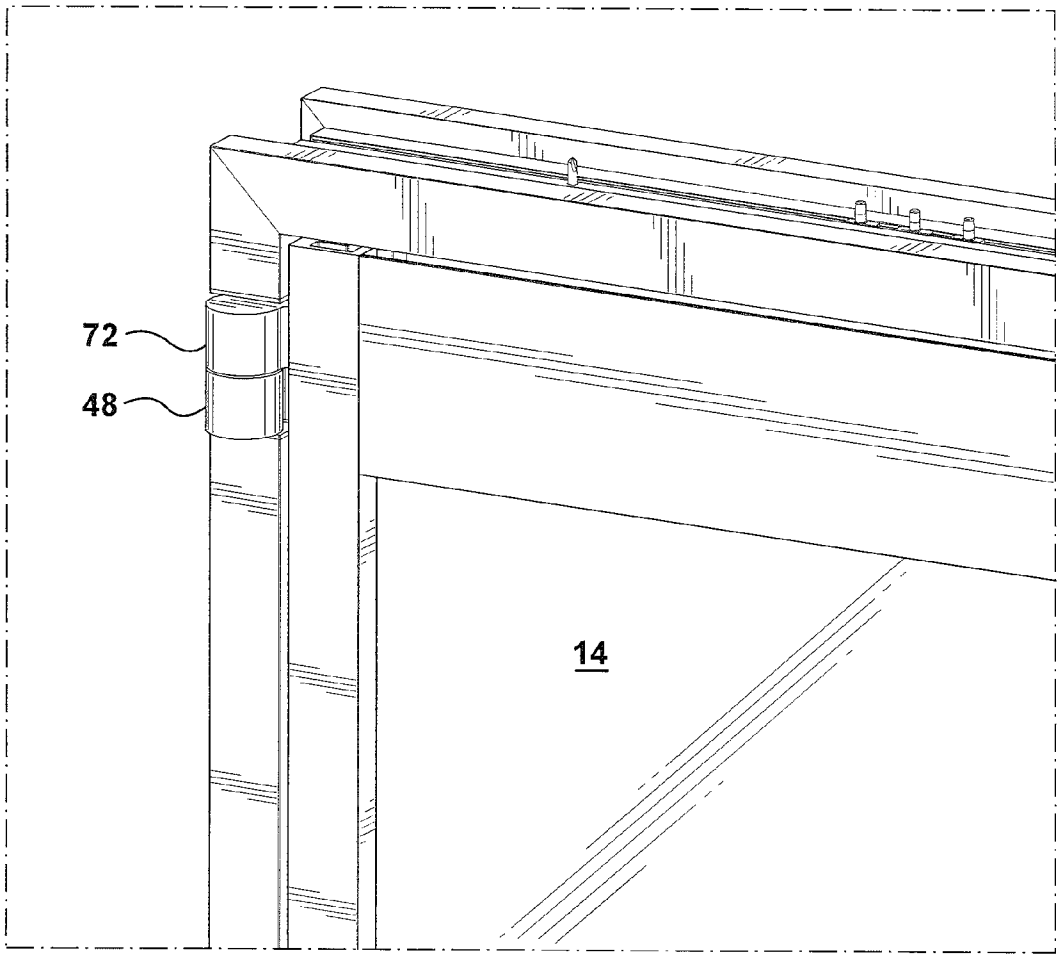
FIG. 7 is a partial perspective view showing a top portion of the door of the interior wall system.

Referring now to FIGS. 4-6, a lower door hinge portion 70 and an upper door hinge portion 90 are secured to the door frame 100 of the door 14. Preferably, the lower door hinge portion 70 and upper door hinge portion 90 are identical. Consequently, the same part numbers will be used to identify like parts in the upper and lower door hinge portion. A barrel portion 72 projects outwardly from a block 74 (only visible in FIG. 6). The barrel portion 72 has an open bottom end 73 (only illustrated in FIG. 4). A preferably bronze bushing 75 (only illustrated in FIG. 4) is secured within the barrel portion 72 by any suitable means, such as by a press fit. The bushing 75 has a barrel bore 76 which extends upwardly from the bottom end of the barrel portion 72. The barrel bore receives the upper end 64 of each pivot pin 60, 62.

Referring now to FIG. 6, the lower door hinge portion 70 and the upper door hinge portion 90 each preferably include an upper door mounting plate and a lower door mounting plate. The upper door mounting plate and the lower door mounting plate are connected to upper and lower horizontal portions, respectively, of the door frame 100. Preferably, the upper and lower door mounting plates are identical. Accordingly, only the upper door mounting plate 110 is shown in FIG. 6. The door mounting plate is horizontally oriented and secured to the horizontal portions of the door frame 100 by any suitable number of fasteners, such as bolts 112. A boss 114 projects upwardly from the door mounting plate 110. The boss 114 is preferably welded to the door mounting plate 110. The boss 114 has a horizontal bore (not shown) through which a connector bolt 116 passes. The distal end of the connector bolt 116 engages a horizontal threaded opening 118 in an inner surface 120 of the block 74. This arrangement permits adjustment of the horizontal position of the block 74, and thereby the horizontal position of the barrel portion 72.

An exemplary assembly sequence of the components of wall system 10 will now be described with reference to FIGS. 1-7. First, the floor assembly 16 is leveled (in accordance with parameters of the wall system design which may be predetermined in the design phase or identified on site during construction). Then, the glass panels 12*a*,12*b*, and ceiling assembly 17 are installed, all as described in U.S. Pat. No. 7,814,711 and pending U.S. patent application Ser. No. 13/742,737.

The vertical post 20 is fitted onto the vertical leveling assembly 22 and located beside the leveled floor rail 18. In particular, the bottom end of the post 20 rests on the flanged portion 32, such that the sleeve 30 and threaded rod 26 are received within the interior space of the post 20. The vertical position of the post 20 is adjusted by turning the nut 28, which causes the sleeve 30 (and thereby the flanged portion 32) to move vertically along the threaded rod 26. Once the desired vertical position of the post is achieved, the post 20 is secured to the floor rail 18 using the L-bracket 21, which is secured to the post 20 and floor rail 18 by any suitable fasteners (not shown).

The lower hinge portion 40 and upper hinge portion 50 are then secured to the post 20 at desired locations. Specifically, the post mounting plate 42 of each hinge portion 40, 50 is secured to the post 20 by fasteners 150 (such as bolts) which pass through the plate fastener holes 44 and post fastener holes 23. As discussed above, the lower end 61 of the lower and upper pivot pins 60, 62 is secured within the base bore 49 of each bearing portion 48. Post trim pieces 130 are then connected to the post 20 such that only the arm 46 and bearing portion 48 of each hinge portion 40, 50 is exposed.

The lower door hinge portion 70 and upper door hinge portion 90 are then secured to the door frame 100 of door 14. Specifically, the door mounting plate 110 of each door hinge portion 70, 90 is secured to the horizontal portion of the door frame 100 by fasteners (such as bolts 112) which pass through holes in the door mounting plate 110 and the door frame 100. The connector bolt 116 engages the threaded opening 118 in the inner surface 120 of the block 74 to secure the block 74 to the mounting plate 110. The connector bolt 116 is turned to adjust the horizontal orientation of the block 74, so that the outer face 136 of the block 74 is flush with door trim pieces 140 (shown in FIG. 3).

The door 14 is then connected to the lower and upper hinge portions 40, 50 by locating the upper end 64 of each pivot pin 60, 62 in the barrel bore 76 of the bushing 75 of the door hinge portions 70, 90.

The exemplary door hinge assembly described above permits the bottom hinge to be located above the floor surface. Furthermore the offset bearing portion 48 and barrel portion 72 permit the door 14 to rotate almost 180° from the closed position.

While the present invention as herein shown and described in detail is fully capable of attaining the above-described objects of the invention, it is to be understood that it is the presently preferred embodiment of the present invention and thus, is representative of the subject matter which is broadly contemplated by the present invention, that the scope of the present invention fully encompasses other embodiments which may become obvious to those skilled in the art, and that the scope of the present invention is accordingly to be limited by nothing other than the appended claims, in which reference to an element in the singular is not intended to mean "one and only one" unless explicitly so stated, but rather "one or more." All structural and functional equivalents to the elements of the above-described preferred embodiment that are known or later come to be known to those of ordinary skill in the art are expressly incorporated herein by reference and are intended to be encompassed by the present claims. Moreover, it is not necessary for a device or method to address each and every problem sought to be solved by the present invention, for it is to be encompassed by the present claims.

The invention claimed is:

1. A door hinge assembly for pivotably connecting a door to an interior wall system, the interior wall system having a bottom rail configured for installation in a building having a floor, the door having a door frame, the assembly comprising:

a) a generally vertical post configured to be secured to the bottom rail, the post having a plurality of post fastener holes therein;

b) an upper post hinge portion and a lower post hinge portion, each post hinge portion comprising:

i) a post mounting plate having a plurality of plate fastener holes therein, wherein the post mounting plate is configured to be secured to the post by a plurality of fasteners, wherein each of the fasteners is adapted to pass through a corresponding plate fastener hole and a corresponding post fastener hole; and ii) a bearing portion projecting outwardly from the post mounting plate, the bearing portion comprising a base, the base having a vertical base bore;

c) an upper door hinge portion and a lower door hinge portion, each door hinge portion comprising:

i) a block securable to a door frame;

ii) a barrel portion projecting outwardly from the block, the barrel portion having a vertical barrel bore;

d) an upper pivot pin and a lower pivot pin, each pivot pin having a first end configured to be secured in the base bore and a second end configured to be pivotably located in the barrel bore, wherein the upper pivot pin is adapted to pivotably connect the upper post hinge portion to the upper door hinge portion, and the lower pivot pin is adapted to connect the lower post hinge portion to the lower door hinge portion.

2. The assembly of claim 1, wherein the bearing portion of the lower post hinge portion is spaced apart from the floor.

3. The assembly of claim 1, wherein the first end of each pivot pin is fixedly secured in the base bore by an interference fit.

4. The assembly of claim 3, wherein the first end of each pivot pin has a larger diameter than the second end.

5. The assembly of claim 4, wherein each pivot pin comprises an annular shoulder located between the first end and the second end.

6. The assembly of claim 5, wherein the shoulder is located at the mid-point of each pivot pin.

7. The assembly of claim 6, wherein the first end of each pivot pin is the upper end and the second end of each pivot pin is the lower end.

8. The assembly of claim 1, wherein the barrel portion is adapted to locate above the base.

9. The assembly of claim 8, wherein the barrel portion comprises an outer housing and a bushing secured within the housing, wherein the barrel bore is defined within the bushing.

10. The assembly of claim 8, wherein the bearing portion further comprises an arm connecting the base to the post mounting plate.

11. The assembly of claim 1, wherein the block defines a block surface adapted to be flush with a door trim surface.

12. The assembly of claim 11, further comprising, an upper door mounting plate and a lower door mounting plate, each door mounting plate adapted to be secured to the door frame, each door mounting plate comprising a boss, wherein each block is secured to the door frame by the corresponding door mounting plate

13. The assembly of claim 12, wherein each door mounting plate is oriented horizontally, wherein the upper door mounting plate is adapted for connection to an upper horizontal member of the door frame, wherein the lower door mounting plate is adapted for connection to a lower horizontal member of the door frame.

14. The assembly of claim 13, wherein the boss has a substantially horizontal hole, wherein the block is secured to the boss by a bolt which passes through the horizontal hole and is received within a threaded horizontal opening in an inner surface of the block.

15. The assembly of claim 14, wherein the bolt is adapted to rotate within the threaded horizontal opening, thereby causing the block and barrel portion to move horizontally in relation to the door frame.

* * * * *